US007547200B2

(12) United States Patent
O'Mahony et al.

(10) Patent No.: US 7,547,200 B2
(45) Date of Patent: Jun. 16, 2009

(54) SELF-LOADING PERISTALTIC PUMP FOR EXTRACORPOREAL BLOOD CIRCUIT

(75) Inventors: John J. O'Mahony, Minnetonka, MN (US); Sonny Behan, Sugar Hill, MN (US)

(73) Assignee: CHF Solutions Inc., Brooklyn Park, MN (US)

( * ) Notice: Subject to any disclaimer, the term of this patent is extended or adjusted under 35 U.S.C. 154(b) by 193 days.

(21) Appl. No.: 11/362,197

(22) Filed: Feb. 27, 2006

(65) Prior Publication Data

US 2006/0140799 A1 Jun. 29, 2006

Related U.S. Application Data

(62) Division of application No. 10/386,655, filed on Mar. 13, 2003, now Pat. No. 7,018,182.

(51) Int. Cl.
*F04B 43/12* (2006.01)

(52) U.S. Cl. ..... 417/477.2; 417/477.12

(58) Field of Classification Search ..... 417/476, 417/477.2, 477.1

See application file for complete search history.

(56) References Cited

U.S. PATENT DOCUMENTS

| | | | | |
|---|---|---|---|---|
| 4,558,996 | A | | 12/1985 | Becker |
| 4,599,055 | A | | 7/1986 | Dykstra |
| 4,674,962 | A | | 6/1987 | Gardineer |
| 4,824,339 | A | | 4/1989 | Bainbridge et al. |
| 4,861,242 | A | | 8/1989 | Finsterwald |
| 4,909,713 | A | | 3/1990 | Finsterwald et al. |
| 4,951,849 | A | * | 8/1990 | Townsend et al. ..... 222/523 |
| 4,976,590 | A | | 12/1990 | Baldwin |
| 5,263,831 | A | | 11/1993 | Kappus |
| 5,387,088 | A | | 2/1995 | Knapp et al. |
| 5,433,588 | A | | 7/1995 | Monk et al. |
| 5,445,506 | A | | 8/1995 | Afflerbaugh et al. |
| 5,462,416 | A | | 10/1995 | Dennehey et al. |
| 5,538,405 | A | * | 7/1996 | Patno et al. ..... 417/326 |
| 5,588,815 | A | * | 12/1996 | Zaleski, II ..... 417/477.2 |
| 5,676,530 | A | * | 10/1997 | Nazarifar ..... 417/477.2 |
| 5,928,177 | A | | 7/1999 | Brugger et al. |
| 6,468,059 | B2 | * | 10/2002 | Haser et al. ..... 417/477.2 |

OTHER PUBLICATIONS

Declaration of Mark Gelfand (six pages) with attachments indentified on the declaration.

* cited by examiner

*Primary Examiner*—Devon C Kramer
*Assistant Examiner*—Dnyanesh Kasture
(74) *Attorney, Agent, or Firm*—Nixon & Vandherhye P.C.

(57) ABSTRACT

A peristaltic pump is disclosed having pump motor with a rotating motor shaft and a shaft axis; a peristaltic pump head rotatably mounted on the motor shaft; a raceway having a semi-circular track arranged around the pump head and coaxial with the shaft axis, wherein the track has a beveled edge at an entrance to the raceway to receive a tube loop being loaded into the pump; the pump head includes at least one roller orbiting the raceway and compressing the tube loop against said raceway, and a cartridge to which the tube loop is attached and mountable on the raceway.

4 Claims, 6 Drawing Sheets

SELF-LOADING PERISTALTIC PUMP FOR EXTRACORPOREAL BLOOD CIRCUIT

CROSS RELATED APPLICATION

This application is a divisional of and claims priority to U.S. application Ser. No. 10/386,655 filed on Mar. 13, 2003 now U.S. Pat. No. 7,018,182 and is incorporated herein by reference.

FIELD OF INVENTION

The present invention relates to the field of peristaltic pumps and more particularly to the field of peristaltic pumps that are used for extracorporeal blood treatment and analysis.

BACKGROUND OF THE INVENTION

A peristaltic pump moves blood, filtrate and other liquids through tubing of an extracorpeal blood circuit. One or more peristaltic pumps may be arranged in a pump console which usually includes a pump controller and user interface. The blood circuit is releasably mounted onto the pump console and the tubing of the circuit is loaded in the peristaltic pumps. The rotating pumps drive blood and other liquids through the tubing of the blood circuit.

An automatic loading mechanism for loading the tubing onto the pumps is desirable to ease the task of inserting the tubing into the pump and to avoid pinching the fingers of the operator loading the tubing. An exemplary automatic tubing loading mechanism, described in U.S. Pat. No. 4,861,242, has a rotating tab extending from the pump head to catch and displace a tube into the track of a raceway in a roller pump. Conventional automatic tube loading mechanisms tend to be mechanically complex, to have tabs and other rotating protrusions that can catch and pinch fingers of operators, have a relatively long pump setup time and to be difficult to operate. Accordingly, there is a long felt need for an automatic pump loading mechanism that is easy to use, mechanically simple and is not prone to pinching fingers while the tubing is being loaded into the pump.

SUMMARY OF INVENTION

In one embodiment, the invention is a peristaltic pump comprising: a pump motor having a rotating motor shaft with a shaft axis; a peristaltic pump head mounted on the motor shaft; a raceway having a semi-circular track arranged around the pump head and coaxial with the shaft axis, where the track has a beveled edge at an entrance to the raceway to receive a tube loop being loaded into the pump; the pump head further comprises at least one roller riding in said raceway and orbiting said shaft axis, where the roller compresses the tube loop against said raceway when said tube loop is mounted in the raceway, and a cartridge to which the tube loop is attached and mountable on the raceway, wherein the cartridge positions a lower section of the tube loop between the track and roller when the cartridge is mounted on the raceway.

In a second embodiment, the invention is a peristaltic pump comprising: a pump knob attached to a knob shaft having a distal treaded section and a proximal beveled outer face; a motor shaft with splines and an inner bevel concentric with the shaft to allow the expansion of the shaft splines when engaged by the beveled outer face of the knob shaft; a pump head comprising a pair of lever mounted rollers and a bore aperture to receive the motor shaft and having a locking mechanism to secure the head to the motor shaft such that the head rotates with the shaft, wherein the levers are pivotably attached to opposite sides of the head and said rollers orbit the motor shaft.

DESCRIPTION OF THE INVENTION

Figure 1:
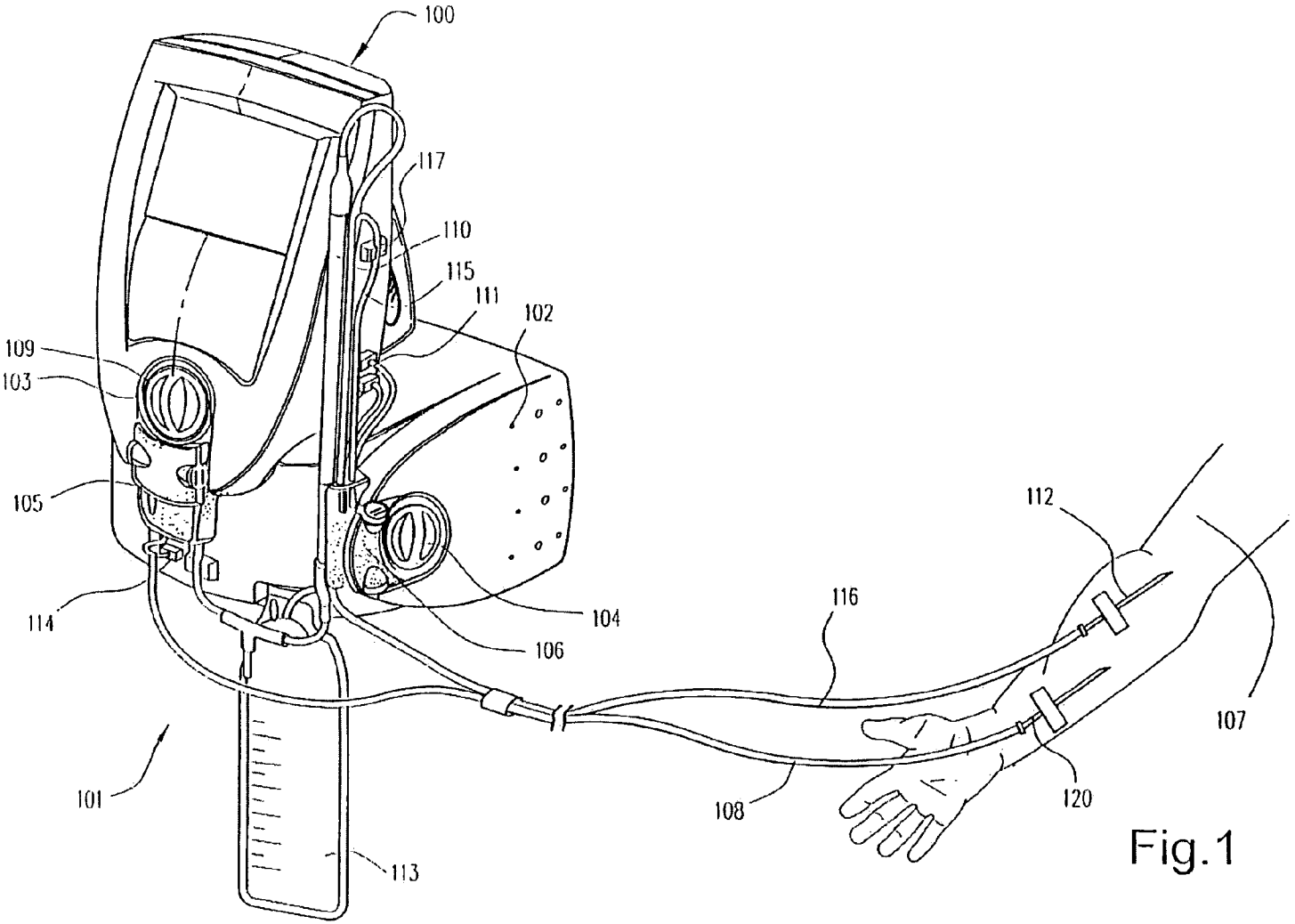
FIG. 1 is a perspective diagram of a front panel of an ultrafiltration pump console.

FIG. 1 shows an ultrafiltration device 100 for the removal of isotonic fluid from the blood of patients 107 suffering from fluid overload. The device 100 includes a disposable blood circuit 101 that is realeasably mounted on a peristaltic pump console 102. The console includes a first peristaltic pump 103 that controls a rate at which blood is withdrawn from the patient 107, and a second peristaltic pump 104 that controls a rate of filtrate, e.g. isotonic fluid, flowing from a blood filter 110 of the circuit. The circuit 101 further includes a pair of circuit cartridges 105, 106 that are removably attached to the pumps and their console. The major blood circuit components comprise the tubing 108, 109, 115, 116; cartridges 105, 106; filter 110; pressure sensors 111, 114; blood leak detector 117 and filtrate collection bag 113. The blood circuit may be disposed of after one ultrafiltration use.

Blood is withdrawn from the patient 107 through a peripheral access cannula 120 and into a withdrawal tube 108. The rate of blood withdrawal is determined by the rotational speed of the first (blood) peristaltic pump 103 that compresses a loop section 109 of the withdrawal tube 108 mounted in a raceway of the pump 103. The withdrawal tubing 108 passes through the pump (see tube loop section 109) and extends to the inlet at the bottom of the filter 110. The tubing loop section 109 extends as a loop from the cartridges 105 of the blood circuit. The cartridge 105 holds the tubing loop section 109 so that it may be easily inserted into the pump by an operator. The cartridge 105 also attaches to the console to hold the tube loop 109 in alignment with the pump. Similarly, the other cartridge 106 holds a loop section of a filtrate line 115 in alignment with the second peristaltic pump 104, and assists the operator in inserting the filtrate line into that pump.

The blood flowing through the blood tubing is monitored on the withdrawal side 108 by an inline blood pressure sensor 114 which may be integral with the disposable circuit 101. Blood is pumped by the first (blood) peristaltic pump 103 through a hollow fiber membrane of the filter 110. The blood passing through the blood passage of the filter (and not through the membrane) is returned to the patient via an infusion line 116 which leads to a second peripheral access site 112 on the patient. A second (infusion) disposable pressure sensor 111 monitors the blood pressure in the infusion line.

Filtrate fluid passes through the filter membrane of the filter 110, and enters the filtrate line 115. The filtrate line is coupled to the second (filtrate) peristaltic pump 104 that controls the withdrawal rate of isotonic fluid (filtrate) from the patient's blood. The filtrate flows from the filtrate line into the collection bag 113.

Figure 2:
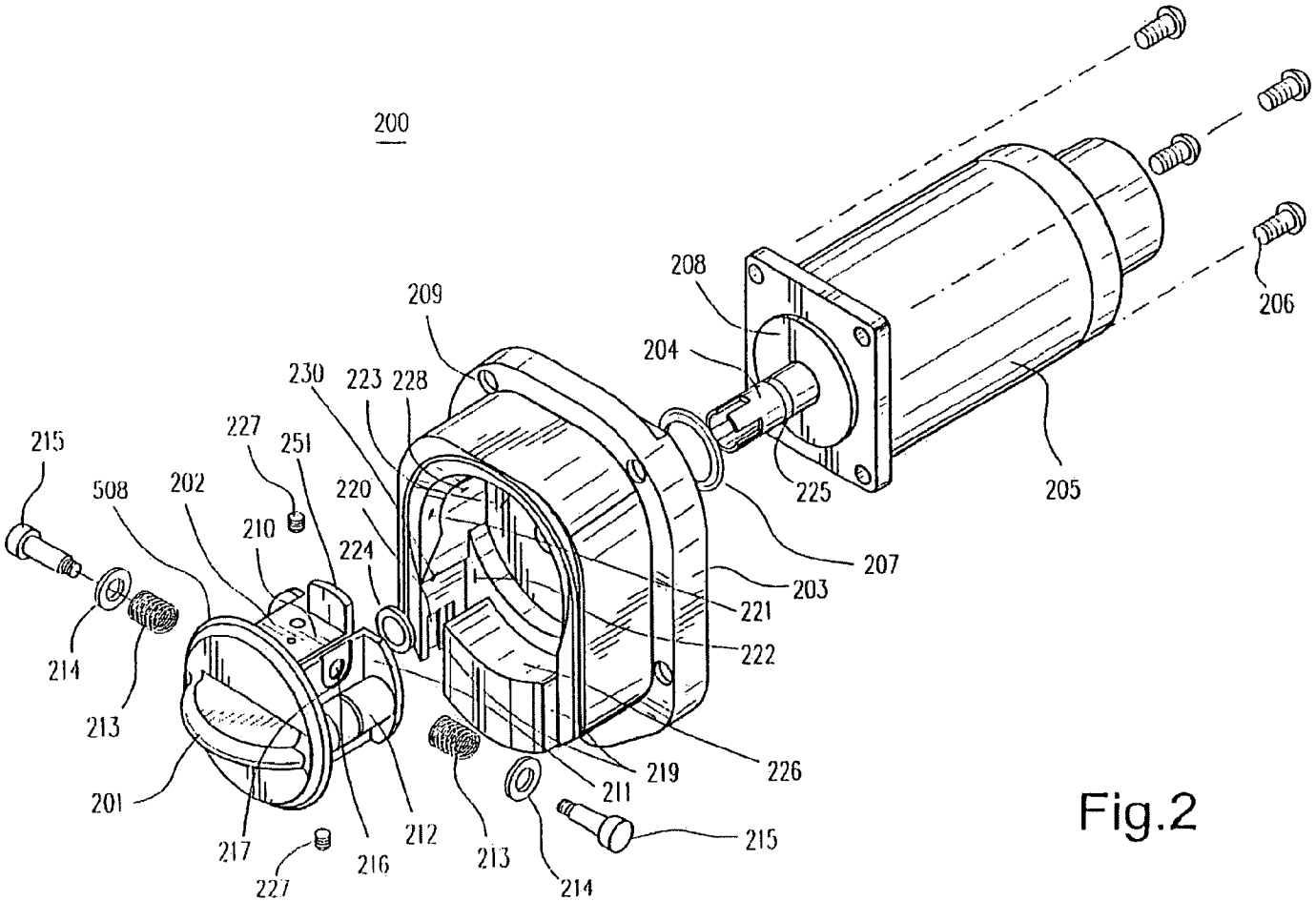
FIG. 2 is an exploded diagram of a peristaltic pump including a pump head raceway, and motor.

FIG. 2 shows an exploded view of the components of a peristaltic pump 200, such as the pumps 103, 104 shown in FIG. 1. The peristaltic pump 200 includes a pump knob 201 mounted on a peristaltic pump head 202, a raceway 203, a motor shaft 204, and a motor 205. The raceway may be an integral piece of machined aluminum. The raceway 203 is exposed and attached to an outer surface of the console 102. The motor shaft 204 extends through a planar base 223 in the raceway, and is attached to the knob 201 and head 202. The motor shaft rotates the pump knob and head within the stationary raceway 203.

The motor 205 is secured to the raceway 203 with screws 206 that fit into screw holes 209 of the raceway. The motor is housed within the console 102. The mounting face is sealed to a back surface of the raceway by an O-ring seal 207. The seal 207 is located in a U-shaped circular grove in the back of the base 223 of raceway 203. The seal 207 is pressed between the mounting face 208 of the motor and the back surface of the raceway. The O-ring seal 207 prevents liquids from leaking into the console and reaching the electronic circuitry within the console.

Figure 3:
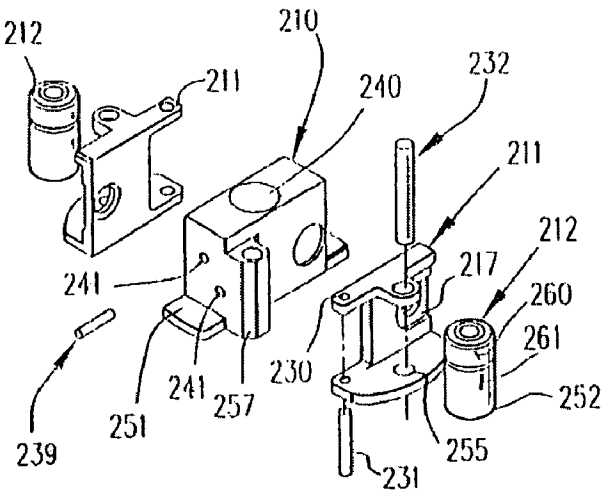
FIG. 3 is an exploded diagram of the peristaltic pump head.

As shown in FIGS. 2 and 3, the peristaltic pump head 202 includes a generally rectangular pump head body 210, and a pair of lever arms 211 pivotably attached to opposite sides of the body. A roller 212 is rotatably mounted on each of the lever arms. The rollers 212 are mounted on a shaft 232 that fits in holes 255 in each arm 211. Each lever arm 211 is attached to the pump head body 210 by a pivot pin 231 and a shoulder screw 215. The pivot pin 231 fits into a ridge 257 of the body to pivotably attach the arm 211 to the body 210.

A compression spring 213 on the screw 215 biases the lever arm and roller outward from the pump head body 210. The spring 213 slides axially onto the screw and is compressed between the pump head body 210 and the lever arm 211. A washer 214 for the shoulder screw fits in the recess 217 on the lever arm 211. The shoulder screw 215 slides through aperture 216 of the lever arm and is screwed into the pump head 202. The shoulder screw limits the angular travel of the lever arm 211 when pivoting about ridge 257 on the pump head body. The shoulder screw 215 is held in place with a set screw 227 that screws into the body 210 and abuts against the shoulder screw. The plastic washer 214 also reduces noise as the lever arms 211 pivot while the rollers 212 are being disengaged from the peristaltic tubing loop as the pump head rotates.

Each lever arm 211 and its roller 212 are pivoted away from the pump body 202 and towards the raceway by its respective compression spring 213. The force applied by each compression spring 213 pushes its rollers against the raceway and pinches (occludes) the portion of the tube loop 109 between the roller 212 and raceway 203.

As the pump head 202 is rotated, blood or filtrate, liquid in the tube is propelled forward in the tube by the occluding roller. The orbiting movement of the roller causes a positive pressure increase in the tubing 109 in front of the rollers and a negative suction pressure in the tubing behind the rollers. As the roller passes over the tube loop, a suction pressure is created as the tube decompresses by returning from its compressed flat shape to a circular shape. The suction pressure draws liquid into the tube that in turn will be propelled forward by the following roller when it engages the tube loop. The rotation of the rollers and the cyclical compression and decompression of the tube loop propels the blood and filtrate through the tubes of the blood circuit.

The raceway 203 includes two vertical tube slots 219 that are each open at a bottom end and have an opposite end intersecting tangentially with the semi-circular raceway track 228. The slots 219 and track 228 receive the tube loop. The outer side surfaces of the tube slots 219 each have a rectangular recess 220 which provides a catch to lock a tube cartridge 105, 106 to the raceway 203. To load the tubing on the pump, each cartridge with a loop 109 of tubing slides into the raceway 203. The back side of each cartridge is hollow (see FIG. 6) to fit over a boss 226 on the raceway. The boss defines the inner sidewalls of the tube slots 219 and a lower semi-circular sidewall of the raceway track 228. The disposable cartridge 105, 106, 300 (FIG. 6) is centered on the raceway by the boss 226 that fits into the cavity 302 in the backside of the cartridge. The boss also prevents the cartridge from oscillating at the frequency of the peristaltic roller engagement as the pump rotates due to the forces induced on the peristaltic tubing segment when a roller engages and disengages. Latches 306 (FIG. 6) on the sides of each cartridge engage the recesses 220 and snap into the raceway 203.

The outside proximal face of the semi-circular raceway track 228 is beveled 221 to facilitate sliding the tube loop between the pump knob 201 and raceway 203 as the tube is loaded. The raceway track has a generally straight surface along its width and is a uniform radius from the axis of the raceway, which is coaxial with the motor shaft 204. The knob has a diameter larger than the diameter of the raceway track 228. A gap 507 (see FIGS. 9 and 10) between the knob 201 and the track 228 allows the tube loop to slide into the track 228. To provide a consistent height between the pump head 210 and raceway base 223, an O-ring 224 fits into an annular groove 225 in the motor shaft 204. The O-ring 224 prevents the pump head from sliding too far along the shaft 204 and bottoming out on the base 223 of the raceway.

FIG. 3 is an exploded view of the components of the peristaltic pump head body 210 without the shoulder screws 215, compression springs 213 and plastic washers 214. The lever arms 211 are attached to the pump head body 210 with steel pivot pins 231. The pins 231 have an interference fit with the lever arms 211 and a loose fit with a conduit through the ridge 257 of the pump head body 210. On each lever arm, the pins 231 provide a fulcrum about which pivots the lever arms 211 on the pump head body. The pins 231 rotate within the pump head as the lever arms rotate cyclically when the rollers 212 engage and disengaged from the pump tubing. The roller is free to rotate about pin 232 while the pin is held in place with an interference fit with the holes 255 of the lever arm. The rollers on the pair of lever arms on each body 212 freely rotate when in contact with the tubing 109 as the pump head is turned by the motor.

The pump head body has a mounting bore 240 that tightly fits over the motor shaft 204 when the body is mounted on the shaft. Two pins 239 are inserted into the pump head body 210 via side bores 241 and protrude through the body and into bore 240 for the motor shaft. The pins 239 ensure that the head rotates with the shaft. The pins 239 fit in the slots 233 (FIG. 5) on the motor shaft 204 when the pump head is connected to the motor and prevent the peristaltic pump head 210 from slipping on the motor shaft during operation. The pump head body 210 mounting bore 240 slides over the motor shaft 204 provided that the pins 239 in the holes 241 are aligned with the slots 233 in the motor shaft.

To prevent the tubing 109 from sliding past the distal ends 252 of the rollers 212, guide tabs 251 on opposite corners of housing 210 stops the tube from sliding beyond of the rollers. As the pump rotates, the guide tabs 251 deflect the tubing back towards the proximal ends of the rollers. The guide tabs preferably have a thickness of at least 5 millimeters thereby interfacing with the tube loop before it extends beyond the occlusive section of the roller. The guide tabs are separated from the base 223 of the raceway by the pump head 202 lying on the o-ring 207 seated on in the groove 225 of the shaft 204. The ledge 222 has a semi-circular edge that completes a circle partially formed by the semi-circular track 228. The ledge 222 ensures that the cartridge and tube loop do not abut against the planer base 223 of the raceway. In addition, the orbiting guide tab 251 ensures that the tube loop does not bind against the corner of the semi-circular track 228 and the base 223. The guide tab function can also be accomplished by having a longer roller 212 that is sufficiently long enough to stop the tube from sliding off the distal end of the roller 252 and binding in the corner between the track 228 and base 223.

The roller 212 consists a larger diameter cylindrical portion 260 and a coaxial smaller diameter cylindrical portion 261. The large roller section 260 is positioned proximate the beveled face 221 at the entrance of the raceway track 228. The large roller section 260 is the first roller portion to touch the tube loop as the loop is loaded into the raceway. As the loop is loaded, the tube 109 slides between the track 228 and the large diameter roller portion and then continues to slide over to the smaller diameter portion 261 of the roller. The large diameter roller section 260 prevents the tube loop 109 from exiting the proximal entrance of the pump once the tube has been correctly loaded by applying a force to push the tube towards the small diameter portion 261 of the roller, the working occlusive section of the roller. During normal pump operation, the tube loop 109 is positioned between the raceway track 228 and the smaller diameter section 261 of the roller.

Figure 4:
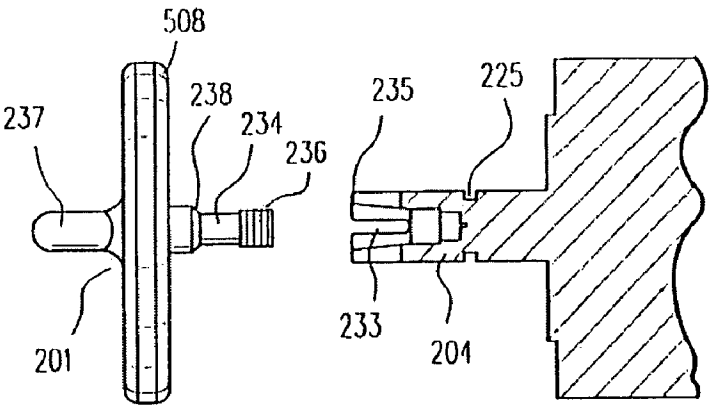
FIG. 4 is a side view of the peristaltic pump knob with a cross-sectional view of the motor on which the knob mounts.
Figure 5:
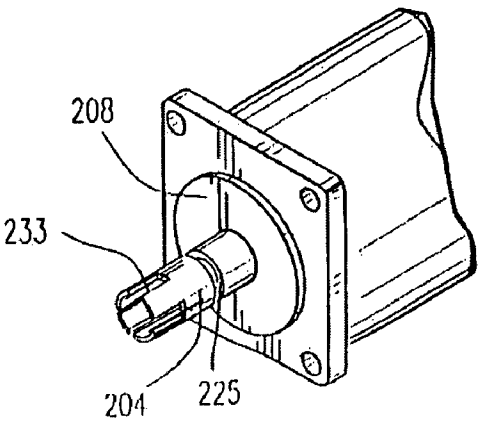
FIG. 5 is an isometric diagram of the motor shaft and pump rotor.

FIGS. 4 and 5 are diagrams of the locking mechanism between the pump knob 201 and the motor shaft 204. The pump knob comprises a polymer handle 237 and a steel shaft 234. The steel shaft 234 has a bevel shoulder 238 and a threaded shaft 236. The motor shaft 204 includes a steel rod with four slots 233, and a hollow shaft with an inner bevel shoulder 235 and a threaded recess to receive the threaded shaft 236 of the pump knob. The bevel 238 on the shaft 234 of the pump knob is greater in angle than the inner bevel 235 of the center hollow shaft in the motor shaft 204 to lock the knob shaft to the motor shaft. Locking is achieved by the splaying of the motor shaft when the knob shaft is screwed into the motor shaft and as the bevels 235 and 238 engage during the threading process of the pump knob shaft into the motor shaft.

The pump head 210 is locked to the motor shaft 204 when the pump knob 201 is screwed into the motor shaft. The knob is hand tightened so that the threaded end of the knob shaft can unscrew the knob from the motor shaft to easily remove the knob and pump head from the raceway for cleaning. The locking mechanism between the knob shaft and motor shaft also has the advantage of ensuring concentricity between the outer surface of the rollers and the motor shaft to ensure equal compression force of the compression springs and rollers acting on the tube loop 109. The pair of rollers 212 should orbit the motor shaft in a circular path. Eccentricity of the orbit of the rollers about the motor shaft would result in a difference in the pressure exerted by each roller as they engage the tube loop and result in a difference in the pressure applied by each roller to the tube. Centering the pump head 202 on the motor shaft and in the raceway track 228 also avoids unequal roller pressures being applied to the tube loop 109. The pump head is centered on the motor shaft by ensuring that shaft hole 240 is centered in the pump head 210 with respect to the rollers.

Figure 7:
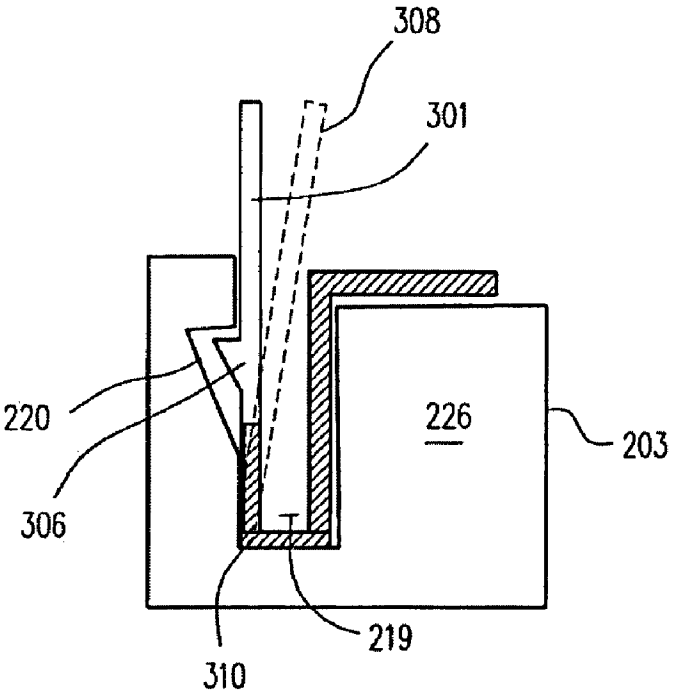
FIG. 7 is a schematic diagram illustrating the operation of the tube attachment mechanism of the cartridge to the pump raceway.
Figure 6:
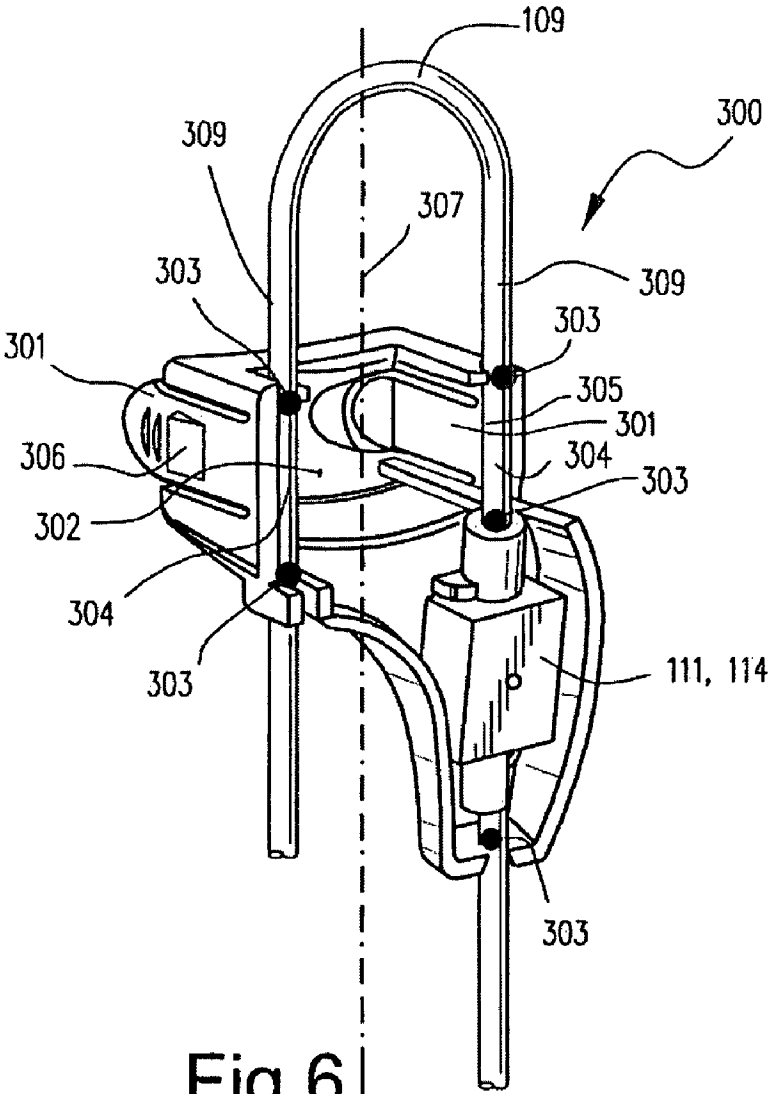
FIG. 6 is an isometric diagram of a portion of a blood pump cartridge.

FIGS. 6 and 7 show a peristaltic pump cartridge 300, such as cartridges 105, 106. The cartridge may be a plastic housing that holds the tube loop 109 and a pressure sensor 305. The cartridge clips onto the raceway when the tube loop is loaded into the pump. The disposable cartridge includes two cantilevered clips 301 that snap fit into the recess slots 220 on the raceway 203 (FIG. 2). The tube loop 109 is attached to the cartridge by spots of glue 303 at the entry and exits points of the tubing path through the cartridge. Glue spots 303 are also applied to tube on opposite sides of the pressure sensor 111, 114. The cartridge has a vertical plane 307 defined by the tube legs 304 of the tube loop.

The cantilever clips 301 each include a wedge 306 that cause the cantilever clips to be displaced inward by the raceway towards the center line 307 of the cartridge, as the cartridge is inserted into the raceway. The wedges 306 slide over the raceway and are pushed inwards as depicted by the broken line clip 308 (FIG. 7) during insertion of the cartridge. The cantilevered clips 301, 308 bend about the point where the clip merges into the base 310 of the cartridge. The user holds the cartridge by the cantilever clips 301 to insert and retract the cartridge from the raceway. The clips 301 are generally held between the index finger and the thumb. Once the cartridge is inserted on the pump raceway, the wedge 306 on the cantilever clips 301 latches the recess 220 in the raceway to hold the cartridge in the raceway. To retract the cartridge from the raceway, the clips are squeezed by an operator so that the edges of the wedge 306 will not catch on the recess 220 on the raceway as the cartridge 300 is retracted. After the cartridge is removed from the boss raceway 226, the pump knob 201 is twisted to pull the tube loop 109 out from between the rollers and raceway track.

Figure 9:
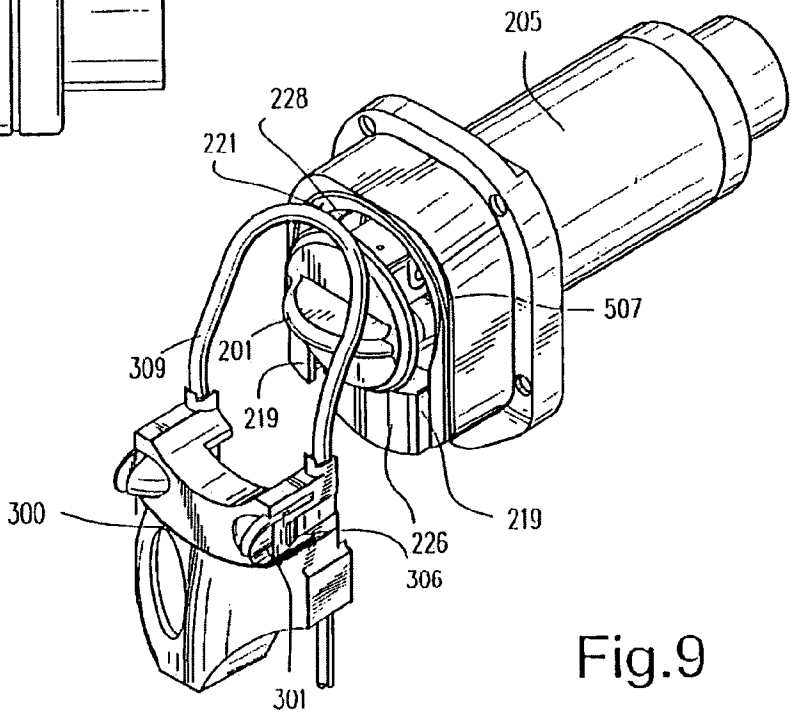
FIGS. 8 and 9 are side and perspective views respectively illustrating the angle on the tubing loop in the cartridge which assists in automatically loading the tube loop onto the peristaltic pump.
Figure 8:
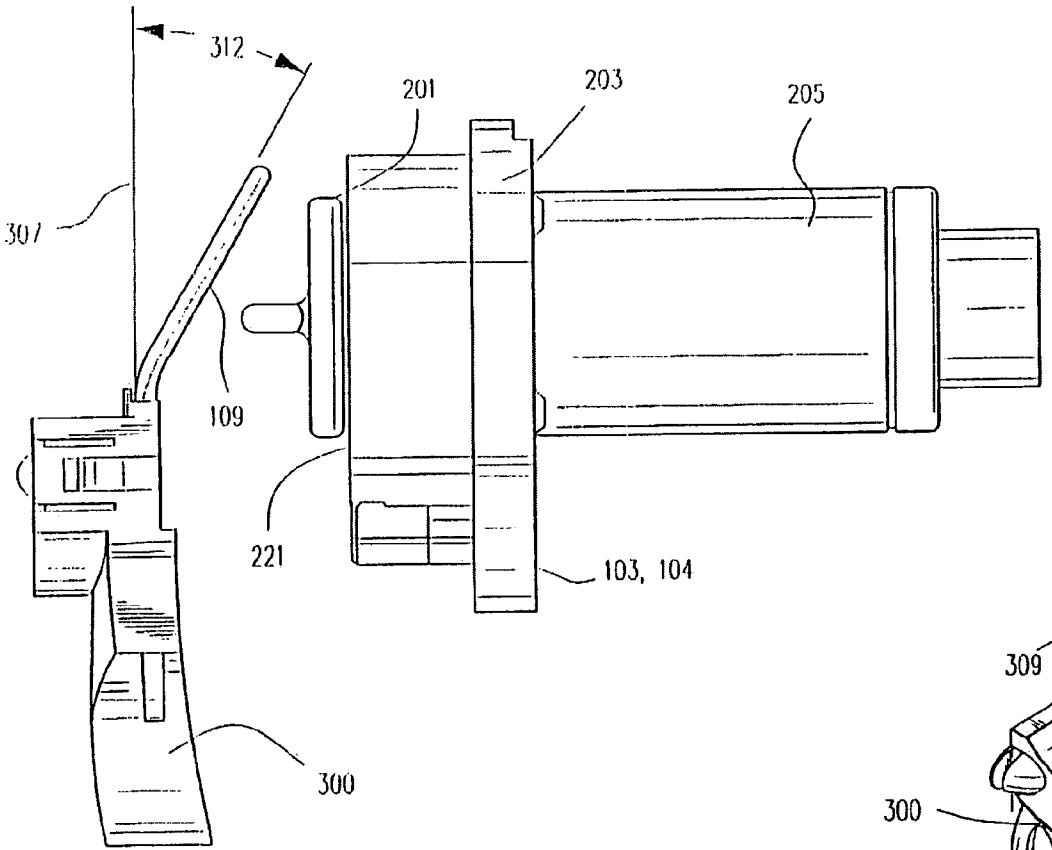

During cartridge assembly, the peristaltic tube loop 109 may be attached to the cartridge during the glue operation so that the tube loop forms an angle 312 (FIG. 8) forward towards the distal end of the pump and away from the cartridge plane 307. FIGS. 8 and 9 show how the cartridge is aligned with the pump 103, 104 before being inserted into the raceway 203. The peristaltic tube loop 109 is angled forward at an angle 312 of between 5° to 30° (degrees) towards the distal end of the pump. Tilting the loop 109 towards the pump biases the tubing into the raceway track 228, and facilitates self loading of the tube loop 109.

During insertion, the tube loop 109 is first placed over the pump knob 201 and into a gap 507 between the knob and track 228 of the raceway. The cartridge 300 is then mounted on the raceway 203 using the cantilever clips 301 as a grip to latch the cartridge in place on the boss 226. The cartridge 300 is aligned using the arched boss 226 on the raceway track 228 and the tube slots 219. The tube loop 109 is seated between a bevel 508 (FIG. 10) on the pump knob 201 and the bevel 221 on the raceway track.

When the cartridge is latched on the boss, the cartridge positions a lower section 309 of the tubing loop 109 in a plane 510 that is aligned with the small cylinder portion 261 of the rollers 212. In addition, the tube loop 109 is initially bent back from its normal tilted forward position (angle 312) when the cartridge is first loaded in the raceway. The forward tilt bias of loop also causes the loop to slip between the rollers 212 and raceway track 228. The lower section 309 of the loop is located at an tangential entrance of the track 228 and at the end of one of the tube slots 219. As the rollers are turned, one of the rollers orbiting the track engages the lower section 309 and pulls the tube loop between the roller and the track. The pivoting lever arm 211 allows the tube to slide between the roller and track, and the compression spring 213 acting on the roller compresses the tube once it is between the roller and track. The tube is quickly loaded into the raceway because the cartridge positions the tube loop (see section 309) deep into the raceway track 228, the tube is angled 312 inward towards the pump, and the rollers are necked down (large diameter section 260 to small diameter 261) from front to back of the roller. The necked down rollers cause the tube to move toward the small diameter region 261 of the rollers, once the loop is grasped between the rollers.

Figure 10:
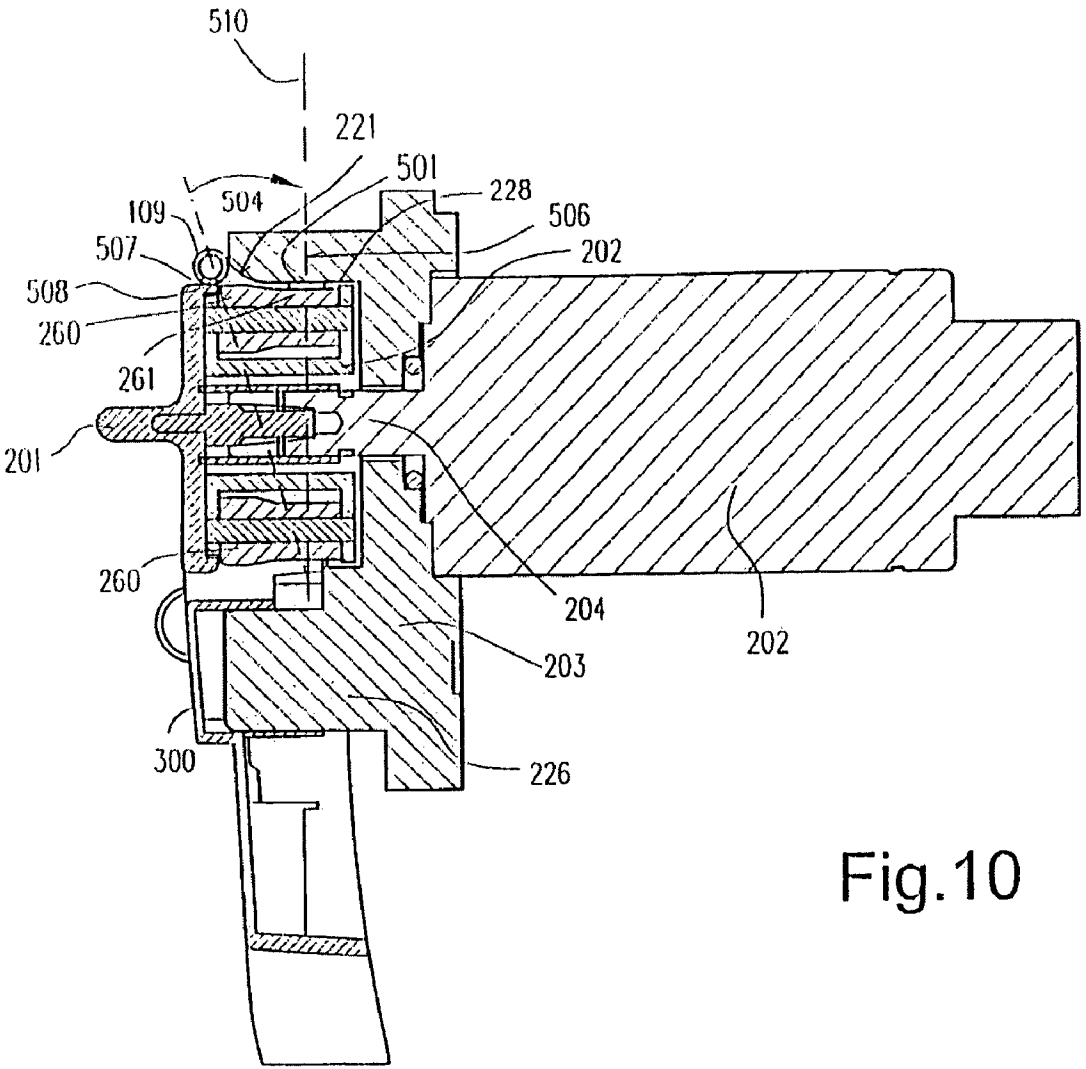
FIG. 10 is a cross-sectional diagram through the motor and cartridge mounted on the peristaltic pump showing the tube loop in both a pre-load and post-load position.

FIG. 10 is a cross-sectional diagram of the peristaltic pump with the tube loop and cartridge in place. The diagram shows the tube loop 109 in a loaded position 501 and the loop in an unloaded position (see position of reference number 109). The tube loop 109 at the entrance to the pump is positioned between the guide bevel 221 on the raceway and the guide bevel 508 on the pump knob 201. The gap between these bevels 221 and 508 provides a path for the tube 109 to enter the pump.

By mounting the flexible tube loop 109 on a disposable cartridge at an angle 312 of 5 to 30 degrees, the cartridge pushes the tube loop towards the inside of the peristaltic pump roller and assists in loading the loop between the rollers and raceway. The tube loop will generally load between the roller and raceway within one orbit of the rollers. Further, the gap between the knob 201 and beveled entrance 221 of the track 228 is behind the cartridge and the lower tube section 305 when the cartridge is mounted in the raceway. When the cartridge is first loaded into the raceway, the tube loop 109 is displaced 5 to 30 degrees behind the cartridge by the gap between the beveled edges of the knob and raceway backward of the cartridge. The cumulative deflection of the tube loop 109 is 10 to 60 degrees as the tube is being loaded into the pump. The resilience of the tube in opposition to this backward deflection exerts a force on the tube in the direction of rollers and predisposes the loop to slip between the rollers and raceway track as the rollers turn in the track. The equivalent of a 10 to 60 degree deflection of the tube loop may also be obtained without angling the tube loop forward on the cartridge by using a longer roller and wider tack 228 to increase the angle of backward deflection of the tube as the cartridge is mounted onto the pump.

To load the tube loop in the raceway, an operator slips the loop over the knob and into the gap 507 between the edge 508 of the knob and the beveled edge 221 of the raceway, aligns the cartridge with the boss 226, and snaps the cartridge into the raceway. The tube is loaded when the rollers and pump are stopped. After the cartridge is snapped in the raceway, the rollers may be manually turned by the pump knob or turned by the motor. The turning of the rollers, the position of the loop 305 deep in the track 228, and the bias of the backward bend of the loop 109 pull the tube loop between the rollers and track and thereby move the loop from the unloaded position to the loaded position. Once the loop is aligned with the gap 507 and the cartridge is snapped over the raceway boss 226, the tube loop automatically loads to the loaded position when the rollers begin to turn in the raceway. The operator need not push the loop 109 between the roller and thereby does not endanger his fingers.

The tube 109 is displaced inwards towards the smaller diameter portion 261 over the larger diameter potion 260 roller by the force exerted by the tube segment being angled away from the pumping region. Further the angle 312 of the tube loop ensures that the tube remains within the operating region (aligned with the small diameter portion of the roller) of the pump once loaded. In the loaded position 501, the tube loop 109 is fully occluded between the rollers and raceway and becomes flattened due to the force exerted by the compression springs on the rollers. The tube 109 when loaded 501 is aligned with a plane 510 of the raceway track 228 and the small diameter portions 261 of the rollers.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A cartridge for a blood pump having a raceway and a pump head both concentric to a motor shaft and a boss on the raceway and adjacent a track included in the raceway, the cartridge comprising:

a cartridge cover having a front face;

a cavity in a back face of the cartridge cover which fits over the boss;

a latch included in the cartridge cover to grasp the raceway when the cartridge cover is fitted over the boss;

a tube loop having a pair of tube legs attached to the cartridge cover and a loop portion mounted to the cartridge cover to extend from said cartridge cover at an acute angle from a vertical plane including the cartridge cover, wherein the tube loop tilts at said acute angle in a direction extending from the front face towards the back face of the cartridge cover, and the tube loop engages the track of the raceway when the cartridge cover is fitted over the boss, and the pair of legs of the tube loop extend through the cartridge cover each as continuous flow passages and extend out from and end of the cartridge.

2. A cartridge as in claim 1 wherein said acute angle of the tube loop is in a range of 5 to 30 degrees with respect to the vertical plane.

3. A cartridge as in claim 1 wherein said tube legs are in the vertical planes, when the cartridge cover is fitted to the boss.

4. A cartridge as in claim 1 wherein said latches of said cartridge cover are disposed on opposite sides of the boss when the cartridge cover is inserted onto the raceway, and the latches snap into recesses in the sides of the tube slots defined by sides of the boss and vertical sidewalls of the raceway.

* * * * *